US009840108B1

(12) United States Patent
Repisky

(10) Patent No.: US 9,840,108 B1
(45) Date of Patent: Dec. 12, 2017

(54) METHOD AND APPARATUS FOR MOUNTING A SHEET

(71) Applicant: Pavel Repisky, Warminster, PA (US)

(72) Inventor: Pavel Repisky, Warminster, PA (US)

( * ) Notice: Subject to any disclaimer, the term of this patent is extended or adjusted under 35 U.S.C. 154(b) by 0 days.

(21) Appl. No.: 14/856,653

(22) Filed: Sep. 17, 2015

(51) Int. Cl.
*B44D 3/18* (2006.01)
*D05C 1/02* (2006.01)
*D06C 3/08* (2006.01)

(52) U.S. Cl.
CPC ..... *B44D 3/185* (2013.01); *B44D 3/18* (2013.01); *D05C 1/02* (2013.01); *D06C 3/08* (2013.01)

(58) Field of Classification Search
CPC ... B44D 3/185; B44D 3/18; E06B 9/52; E04F 10/0633; D06F 59/08; D05C 1/00; D05C 1/02; D05C 1/04; D05C 9/04; D06C 3/00; D06C 3/08
See application file for complete search history.

(56) References Cited

U.S. PATENT DOCUMENTS 2,456,225 A * 12/1948 Thomas ..... B44D 3/185 160/402
3,830,278 A 8/1974 Packer
4,144,660 A * 3/1979 Lamb ..... B44D 3/185 160/378
4,179,830 A 12/1979 Lamb
4,181,046 A * 1/1980 Lamb ..... B25B 7/00 140/123.5
4,665,670 A * 5/1987 van den Burg ..... A01G 9/1415 160/354
4,947,561 A 8/1990 Delacroix et al.
5,133,140 A 7/1992 Frey
5,502,906 A 4/1996 Yamawaki
5,517,775 A 5/1996 Kurtz
5,579,595 A * 12/1996 Dutton ..... B44D 3/185 160/381
6,722,096 B2 * 4/2004 Von Arx ..... E04B 9/303 160/378
8,495,828 B1 * 7/2013 Feldman ..... B25B 7/123 294/16
2009/0056048 A1 * 3/2009 Sharifi ..... B08B 1/00 15/210.1

FOREIGN PATENT DOCUMENTS

JP 09-252899 9/1997
JP 2002-113999 4/2002
KR 2011031744 A * 3/2011
WO WO 2008/142351 11/2008

* cited by examiner

*Primary Examiner* — Ismael Izaguirre
(74) *Attorney, Agent, or Firm* — Thomas L. Adams

(57) ABSTRACT

Gallery mounting of a sheet on a substrate is performed by placing a corner edging around the substrate peripherally. The sheet is positioned on a bead projecting from the corner edging. The sheet is stretched over the bead to elevate a central portion of the sheet from the substrate, and the sheet is peripherally secured in place.

46 Claims, 9 Drawing Sheets

METHOD AND APPARATUS FOR MOUNTING A SHEET

BACKGROUND OF THE INVENTION

1. Field of the Invention

The present invention relates to mounting a sheet, and to arrangements where the sheet may have been artistically marked either before or after mounting.

2. Description of Related Art

As is known, a canvas stretcher is typically a wooden frame over which canvas is stretched and secured in place, before an artist begins painting. This wooden frame is built from four wooden pieces that are arranged as a rectangle and secured at their corners. Finding wooden elements that are adequately straight can be difficult. Also, the finished frame can be distorted by humidity-induced warping, which can affect the tension and flatness of the canvas. Also, the section of canvas lying directly on the frame will be rigidly supported and will not exhibit the feel or "bounce" preferred by artists.

Securing a canvas to such a frame requires some skill, and the results may be non-uniform when using the conventional mounting method, sometimes referred to as "gallery wrap." In this conventional arrangement, the canvas will be stapled onto the back of one side of the frame. Thereafter, the canvas is pulled across the front, and wrapped around the opposite side of the frame, before being stapled on the back. Just before stapling, a desired tension is applied to the canvas manually, or by using pliers designed for this purpose. In some cases, wedges are tapped into the miter joints at the corners of the stretcher frame to separate the joint and increase canvas tension. Thereafter, the process is repeated for the two other sides.

See also U.S. Pat. Nos. 4,179,830; 5,502,906; 4,947,561; 5,133,140; 5,517,775; and 3,830,278 See also Japanese Patent Application 08-072597, filed 27 Mar. 1996; and Japanese Patent Application 2000-347327, filed 10 Oct. 2000; as well as WIPO International Publication 2008/142351, published 27 Nov. 2008.

SUMMARY OF THE INVENTION

In accordance with the illustrative embodiments demonstrating features and advantages of the present invention, there is provided a method for installing a sheet on a substrate using a corner edging with a corner bead. The method includes a number of steps, performed in any order. The method includes the step of placing the corner edging around the substrate peripherally. Another step is positioning the sheet on the bead of the corner edging. The method includes the step of stretching the sheet over the bead to elevate a central portion of the sheet from the substrate. Another step is peripherally securing the sheet in place.

In accordance with another aspect of the invention, a mounting system is provided. The system includes a substrate having a front and a back. The system also includes an edging and a sheet. The edging has a prominent bead and is positioned on the substrate peripherally. The sheet is positioned over the bead and is under tension to lift away from the front of the substrate. The sheet is peripherally secured in place.

In accordance with yet another aspect of the invention, an edging is provided for accommodating mounting of a sheet onto a substrate. The edging includes a plurality of elongated edging segments, each having a transverse pair of flanges forming an inside corner and an outside corner. Each of the plurality of edging segments has a bead. The bead projects distally away from the outside corner.

By employing apparatus and methods of the foregoing type, improved techniques are achieved for mounting sheets intended for artistic markings. In a disclosed embodiment, corner edgings are placed at the upper corners of a solid, high-density foam substrate, or a substrate formed of other materials. These corner edgings have two flanges that embrace the substrate's corner. The edgings also have a rounded bead that projects outwardly from the flanges. The corner edgings can be nailed in place or, in some cases, can simply rest in position waiting for subsequent operations.

In a disclosed embodiment, one edge of a sheet (e.g. canvas, paper, split fiber non-woven sheets, etc.) is secured to the back of the substrate with staples, adhesive tape, double-sided adhesive strips, or the like. The sheet is then routed over the corner edging on one side, across the front of the substrate, and around the corner edging on the opposite side. At this stage the sheet can be stretched manually or with pliers designed for this purpose. Thereafter, the free end of this sheet can be secured to the back of the substrate with staples, double-sided adhesive strips, adhesive tape, etc. With two sides of the sheet now secured, the installer can now repeat the process for the other two remaining sides.

Because the corner edging has a prominent bead, the sheet is lifted off the front of the substrate, to give the sheet the feel and bounce preferred by artists.

In some cases corner edging can be placed on both the upper and lower corners of the substrate. In a disclosed embodiment, the corners of the sheet can be notched to provide flaps, and these flaps are given a pair of creases to assist in installing the lower edging destined for the lower corner of the substrate. A first one of these creases is created by simply wrapping the flap around the upper edging, and then folding the flap around the lower corner of the substrate without the lower edging present. The lower edging can then be placed over the folded flap at the lower corner and used as a guide in creating a second precursor crease by folding the flap back over the lower edging. This second precursor crease is then reversed to form a final crease that becomes a pocket to hold one of the flanges of the lower edging, which is then lifted into position at the lower corner of the substrate. Because creases are first formed without allowing space for the lower edging, bringing the flap into position with the lower edging in place, produces a desirable tension in the sheet.

In another embodiment tension can be created by installing the sheet and corner edgings on a substrate that has been bowed. Tension is created once the bowing is released and the substrate returns to its normal flat condition. Instead of bowing, in one embodiment the substrate is formed of a pair of panels that are hinged together on the front with adhesive tape. Again, the sheet and corner edgings are installed while the substrate is articulated at the hinge joint into an oblique angle, followed by a flattening of the substrate to create tension. Another strip of adhesive is then placed at the back of the temporary hinge joint to prevent further articulation there.

In yet another embodiment, corner edgings are secured in advance to a sheet, using the substrate as a spacing gauge. The edgings are oriented with one of their flanges upright and pressed against opposite edges of the substrate (the substrate is acting as a spacing gauge). Their remaining flanges extend outwardly along the sheet and are eventually secured to the sheet using the spacing determined by the substrate. Thereafter, the substrate is removed and the edgings are rotated inwardly while the substrate returns and is pressed against the formerly upright, free flanges. Because of the geometry, pressing these free flanges down with the substrate intervening, causes a desirable stretching of the sheet.

These corner edgings can be notched or can otherwise be made flexible to follow a curvature in the substrate. In fact, these edgings can accommodate substrates that have convex or concave curvature or have interior openings (e.g. an annular substrate).

An advantage of using foam for the substrate is easy mounting to a wall or other surface. In a disclosed embodiment, a fastener (e.g., a screw, nail, or other fastening means) can be partially driven into a wall and remain proud. The foam of the substrate can be pressed against the protruding portion of the fastener to be impaled thereon. Thus, the substrate can be mounted without the need for hardware or specialized mortises.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
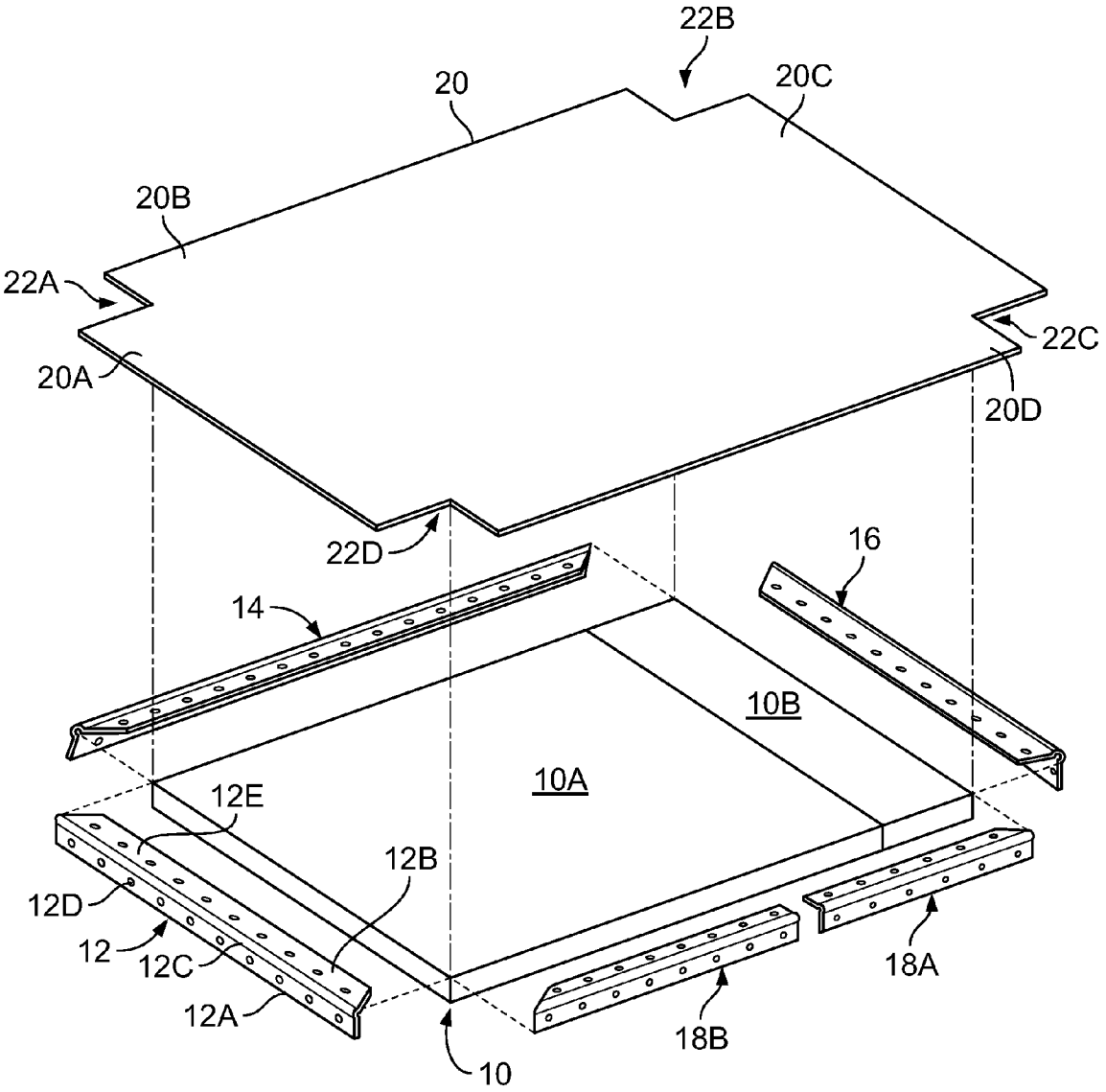
FIG. 1 is a perspective view of a sheet about to be mounted on a substrate in accordance with principles of the present invention.

Referring to FIG. 1, a substrate 10 is shown as two rectangular, solid panels 10A and 10B that are placed side-by-side and attached together to form a single, rectangular substrate with a unitary front surface. Panels 10A and 10B may be attached together with adhesive, by wrapping adhesive tape around their joint, by stapling, or by other fastening means.

In this embodiment each of these slabs 10A and 10B are made of high-density foam, although other types of material can be used instead. Substrate 10 is a simple rectangular solid, but in other embodiments the substrate may have a border that is polygonal or curved. Also, while substrate 10 is shown with a flat front and back, in some embodiments those surfaces may have concave features, such as a dished shape, or parallel grooves. Good results are achieved when substrate 10 has a periphery surrounding an internal region occupied by solid material.

Disposed around the periphery of substrate 10 are a number of separate edging segments 12, 14, 16, 18A, and 18B (also referred to as corner edging). Edging segment 12 is shown about to be mounted at an upper corner on one edge of substrate 10. Edging segment 16 is shown about to be mounted at the opposite edge of substrate 10. Edging segment 14 is shown about to be mounted at an upper corner of an adjacent edge of substrate 10. A pair of aligned edging segments 18A and 18B are shown about to be mounted on an upper corner of substrate 10 on the substrate edge that is opposite to the edge on which edging segment 14 is to be mounted. Once installed in place, edging segments 14 and 18A will reinforce the joint between slabs 10A and 10B.

Edging segments 12, 14, 16, 18A, and 18B have the same cross-section and the same general, elongated configuration. In fact, each of them can have originated as a single piece that is then cut into segments of the desired length. Taking edging segment 12 as an example, it has a pair of transverse flanges 12A and 12B, extending at right angles from a rounded, prominent bead 12C. Flanges 12A and 12B form an inside and an outside corner. Bead 12C projects outwardly (distally) from this outside corner.

Each end of edging segments 12, 14, and 16 are mitered to provide a miter joint, although the mitered ends need not necessarily touch, but the mitering will provide clearance allowing the segments to come closer together. The adjacent ends of segments 18A and 18B are square cut, but their other ends are mitered to interface with segments 16 and 12, respectively.

Flanges 12A and 12B each have an aligned series of nail holes 12D and 12E, respectively. These nail holes may be arranged in a fashion similar to corner beads that are used to finish drywall. In fact in some embodiments, an assembler may use the conventional corner beads normally intended for finishing drywalls. In various embodiments, corner edging 12 may be a metal stamping, plastic extrusion, a pair of plates that are welded together, etc.

Sheet 20 is shown above substrate 10 prior to installation. Sheet 20 has a rectangular outline but with notches 22A, 22B, 22C, and 22D that effectively produce folding flaps 20A, 20B, 20C, and 20D, which surround the central portion of the sheet. Notches 22A-22D align with the four upper corners of substrate 10.

As described further hereinafter, sheet 20 is intended to receive artistic manual markings made with paint, watercolors, charcoals, etc. Accordingly, sheet 20 may be canvas, paper, sheet metal, a plastic membrane, etc. Good results are achieved with split fiber, non-woven sheets, which have a smooth surface, archival quality, excellent stability with changing temperature and humidity, and accommodate a wide variety of marking/painting techniques.

Installation of sheet 20 begins by placing edging segments 12, 14, 16, 18A, and 18B at the indicated upper corners of substrate 10. Thereafter sheet 20 is laid on top and flap 20C (choice of starting flap is arbitrary) is wrapped around edging segment 16 and secured to the back of substrate 10 with glue, adhesive tape, staples, or other fastening means. Thereafter the installer will work with flap 20A.

Figure 2:
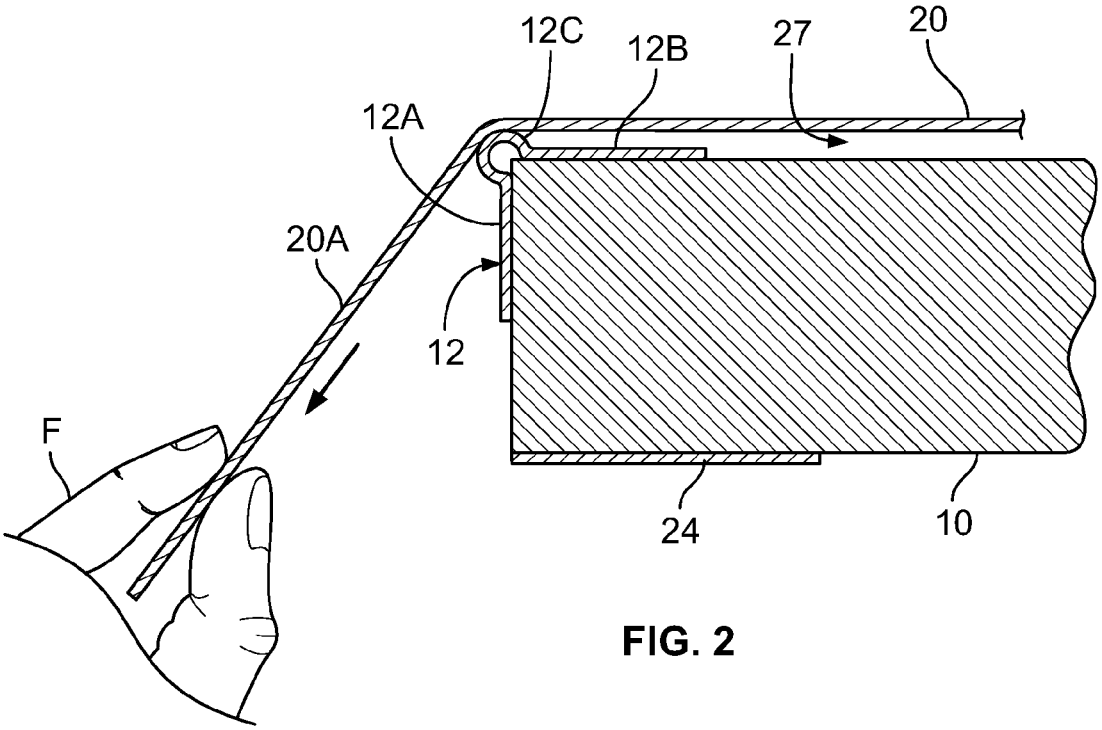
FIG. 2 is a cross-sectional view showing the sheet of FIG. 1 in the process of being mounted on the substrate.

Referring to FIG. 2, an installer in a shown grasping and pulling an end of flap 20A with fingers F. This creates tension across the central portion of sheet 20. The installer will adjust the magnitude and distribution of the tension to remove wrinkles from sheet 20. Double-sided adhesive strip 24 has been installed on the back of substrate 10, reaching from the lower corner inwardly a predetermined amount, and laterally extending across the associated side of substrate 20.

Figure 3:
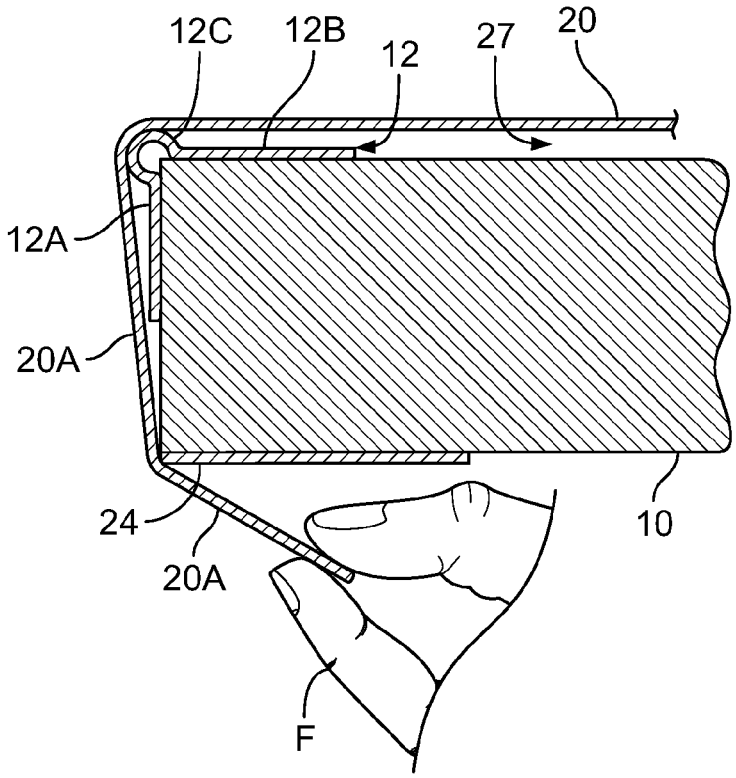
FIG. 3 is a cross-sectional view of the arrangement of FIG. 2 with the sheet being wrapped around a substrate to advance the mounting of the sheet.

Referring to FIG. 3, flap 20A has been wrapped around the lower corner of substrate 10, while the installer maintains even and constant tension in sheet 20. The installer completes this step by pressing flap 20A onto double-sided adhesive strip 24, to secure the flap in place.

The foregoing process that enveloped corner edging 12 and 16 will now be repeated with corner edgings 14, 18A, and 18B (FIG. 1). For example, flap 20B may be folded around corner edging 14 and secured to the back of substrate 10 before wrapping flap 20D around corner edgings 18A and 18B and securing flap 20D in the manner illustrated in FIGS. 2 and 3.

In FIGS. 2 and 3, sheet 20 is shown elevated above substrate 10 to leave underlying space 27. This elevation is achieved because bead 12C is prominent and projects distally from the outside corner formed by flanges 12A and 12B. These Figures show that bead 12C is hollow and is shaped much like three-quarters of a hollow cylinder. In other embodiments, the bead can be solid and may have a cross-section that is oval or polygonal. Good results are achieved when the outside of bead 12C is smooth, which makes pulling sheet 20 over the bead easier.

Figure 4:
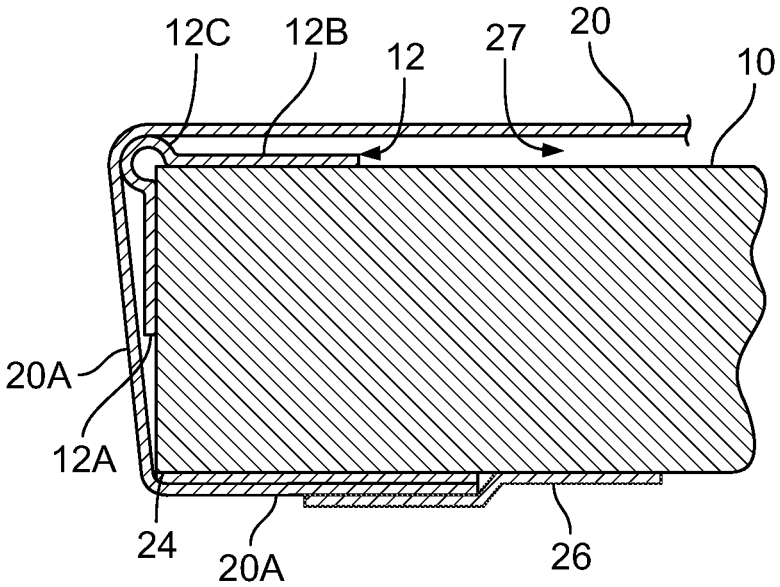
FIG. 4 is a cross-sectional view of the arrangement of FIG. 3 with the sheet secured in place.

Referring to FIG. 4, flap 20A is shown secured onto double-sided adhesive strip 24 at a location on sheet 20 distal from corner edging 12. Additional security is achieved by taping adhesive tape 26 so it reaches from a peripheral position on flap 20A inwardly to an interior position on the back of substrate 10. Tape 26 may be one long strip running parallel to the edge of flap 20A, or may be a number of shorter segments that run transversely across spaced positions on the flap and onto the back of substrate 10.

In any event, sheet 20 is now ready for artistic marking with paint, watercolors, charcoal, or with other artistic marking techniques.

Figure 5:
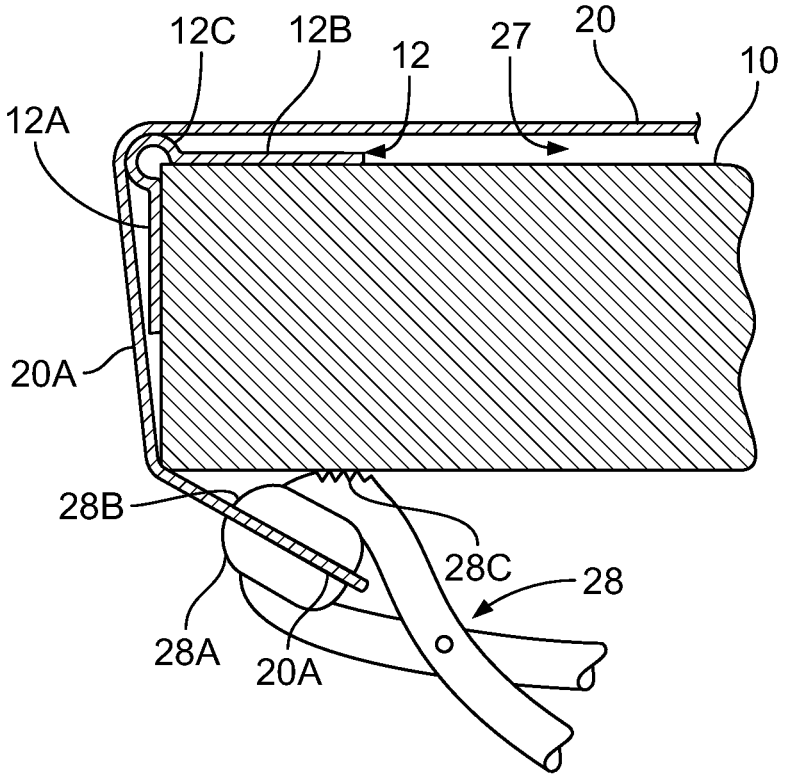
FIG. 5 is a cross-sectional view of an arrangement that is an alternate to that of FIG. 4 wherein a sheet is being stretched with pliers.

Referring to FIG. 5, sheet 20 is wrapped around corner edging 12 and the lower corner of substrate 10, as shown previously in FIG. 3. Unlike FIG. 3, this Figure shows a pulling force being applied to flap 20A by the jaws 28A and 28B of pliers 28. Next to jaw 28B are a series of sharp ridges 28C that take traction on and roll across the back of substrate 10 as an installer leverages pliers 28 to adjust tension. Once the desired tension is achieved, the installer can hold flap 20A in place, release pliers 28, and secure the flap in place with staples (not shown). It will be noticed that in FIG. 5 the installer does not use the double-sided adhesive strip shown previously (strip 24 of FIG. 2).

Figure 6:
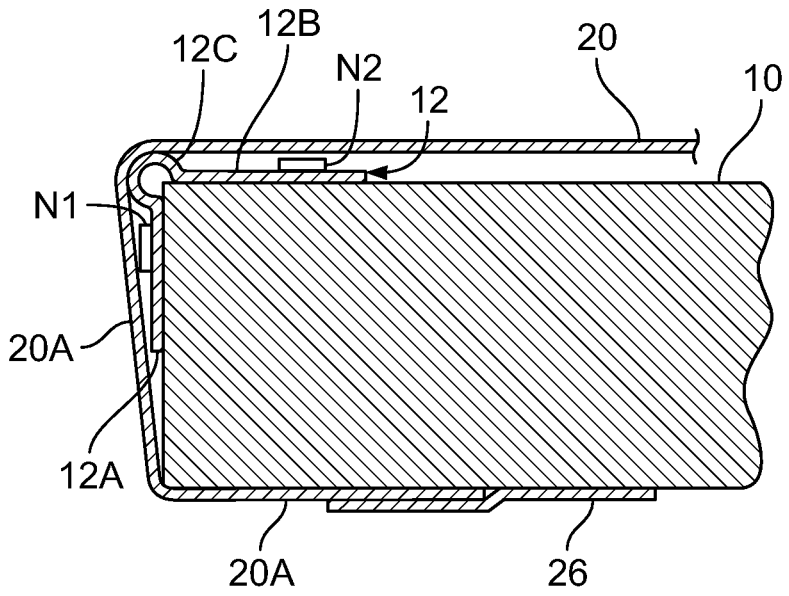
FIG. 6 is a cross-sectional view of an arrangement that is an alternate to those mentioned above.

Referring to FIG. 6, previously mentioned substrate 10 is fitted again with corner edging 12, shown with its flange 12A on the periphery, and flange 12B on the front. In this embodiment flanges 12A and 12B are each secured with a series of nails. Specifically nails N1 and N2 are driven through flanges 12A and 12B, respectively. These nails are secured through pre-existing nail holes (see nail holes 12D and 12E of FIG. 1). As before, the end of flap 20A is secured by adhesive tape 26, but without using a double-sided adhesive strip (i.e., without strip 24 of FIG. 4).

Figure 7:
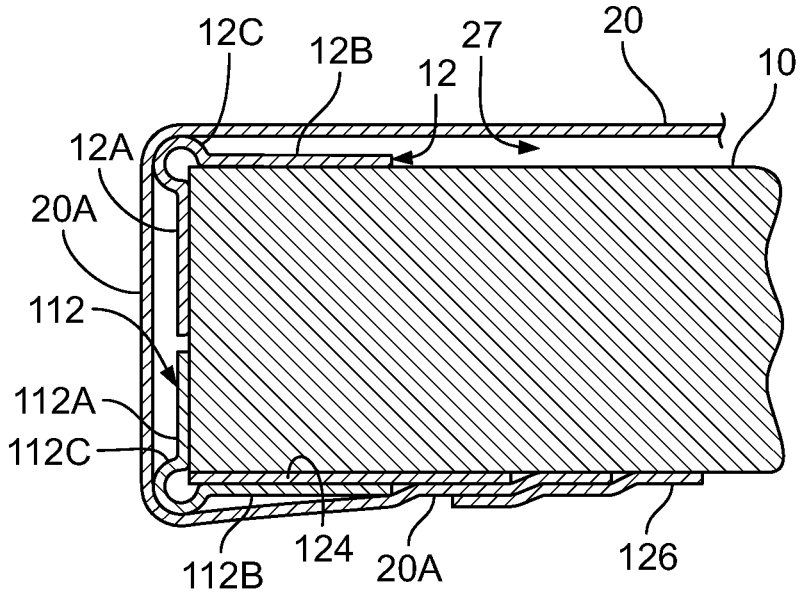
FIG. 7 is a cross-sectional view of an arrangement that is an alternate to those mentioned above.

Referring to FIG. 7, previously mentioned substrate 10 is fitted again with corner edging 12, shown with its flange 12A on the periphery, and flange 12B on the front. The lower corner of substrate 10 has been fitted with another corner edging 112, having its flange 112A on the periphery, and its other flange 112B on the back. Sheet 20 conveniently holds corner edging 12 in position during assembly, but corner edging 112 has a tendency to stray when manipulating sheet 20. For this reason, double-sided adhesive strip 124 has been placed on the back of substrate 24 to hold corner edging 112 in place. Also, double-sided strip 124 extends beyond flange 112B and this extension is used to secure flap 20A to the back of substrate 10. For additional security, adhesive tape 126 is taped over the edge of flap 20A and onto the back of substrate 10.

Figure 8:
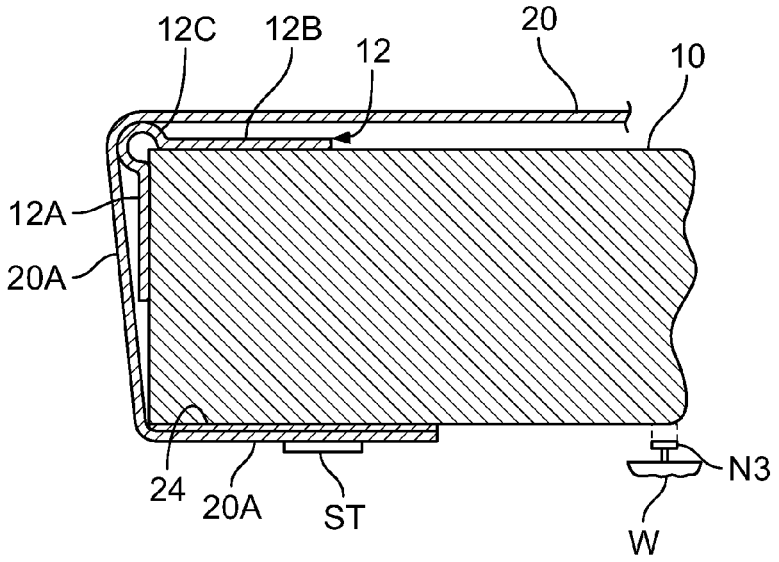
FIG. 8 is a cross-sectional view of an arrangement that is an alternate to those mentioned above, and shown about to be mounted on a wall.

Referring to FIG. 8, sheet 20 has been installed around corner edging 12 and secured in place with double-sided adhesive strip 24 as shown in FIG. 4. Unlike FIG. 4, additional security is provided by staple ST, eliminating the need for the adhesive tape (tape 26 of FIG. 4). Specifically, staple ST is driven through flap 20A and into the back of substrate 10.

In this embodiment, a fastener N3 (e.g., a nail, screw, or other fastener) has been partially driven into wall W so the fastener stands proud. Substrate 10 is pressed firmly against the head of fastener N3 impaling the foam of the substrate on the fastener. Accordingly, sheet 20 can be quickly hung for display without the need for special hardware or for mortises at substrate 10.

Figure 9:
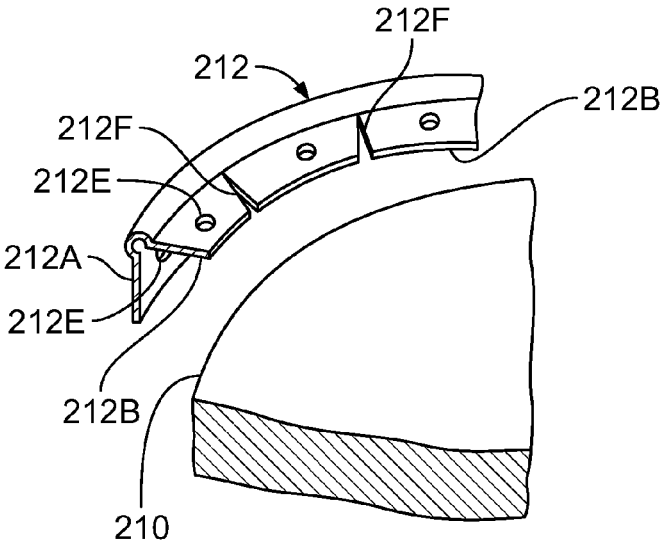
FIG. 9 is a fragmentary, perspective view of an arrangement that is an alternate to those mentioned above.
Figure 10:
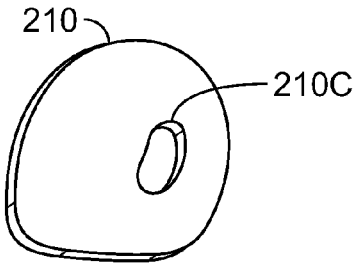
FIG. 10 is a perspective view of a substrate that can be used with the apparatus of FIG. 9.

Referring to FIGS. 9 and 10, corner edging 212 is similar to edging 12 of FIG. 1, and corresponding components have the same reference numerals, but increased by 200. In this embodiment, flange 212B has a number of spaced notches 212F that allows an installer to bend corner edging 212, in this case to create a curvature that matches the curvature of substrate 210. Substrate 210 is again a high density foam, the same as the foams used in the other substrate (i.e., substrate 10 of FIG. 1).

Substrate 210 can have an arbitrary shape such as the annular shape shown in FIG. 10. Annular substrate 210 has a convex outside edge, as well as a concave inside edge that defines an inside opening 210C. Corner edging 212 can be installed at the inside opening 210C, but the installer must bend the edging in reverse to match the concave curvature of opening 210C.

Figure 11:
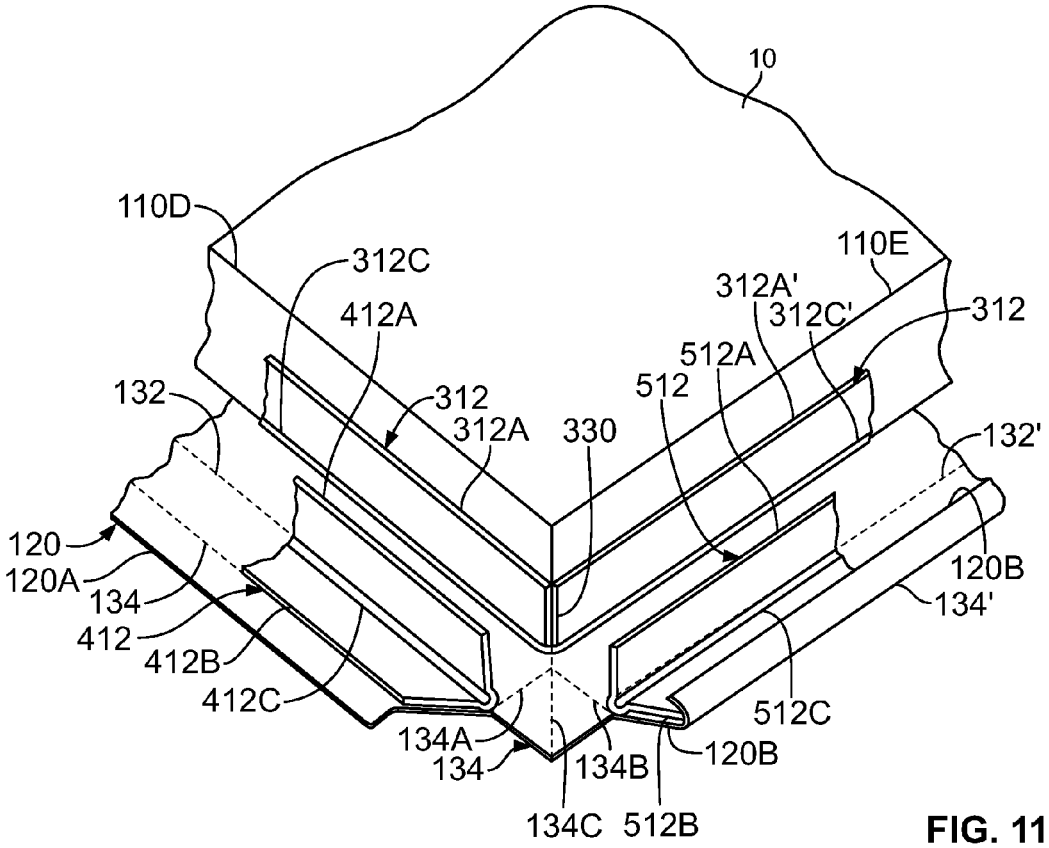
FIG. 11 is a fragmentary, perspective view of another setup that is an alternate to that of FIG. 1.

Referring to FIG. 11, corner edging 312 is similar to the edging previously illustrated, but has been sharply bent 90° to wrap around two adjacent edges of substrate 10 (substrate 10 being illustrated with its back facing up). Such a sharp bend can be achieved by notching a flange as shown in FIG. 9, but in this case cutting a larger, 90° notch. In this embodiment the 90° notch is made in the flange of edging 312 that is hidden in this view against the front of substrate 10. Slit 330 is cut in the other, transverse flange to divide that flange into flange sections 312A and 312A'.

In this embodiment the four lower corners of substrate 10 will be fitted with lower edgings, two of them shown herein as edgings 412 and 512. Edging 412 (512) has a bead 412C (512C) between flange 412A (512A) and flange 412B (512B). The adjacent ends of flanges 412B and 512B are mitered (beveled) to provide mutual clearance when they reach their ultimate destination at the back of substrate 10, as will be described presently.

Sheet 120 has four flaps, flaps 120A and 120B being visible in this Figure. Flap 120A is shown with two creases 132 and 134. Crease 132 is formed by temporarily removing edging 412 and wrapping flap 120A around bead 312C and substrate corner 110D (i.e., crease 132 is created by folding flap 120A around corner 110D).

With the end of flap 120A now lying flat against the back of substrate 10, the inside corner of edging 412 is placed around crease 132 at corner 110D with flange 412B pressing flap 120A down against the back of substrate 10. Next, a precursor to crease 134 is formed by folding flap 120A up, using the distal edge of flange 412B as a folding guide. The fold just created is now reversed by removing edging 412 and refolding the crease in the opposite direction to finalize crease 134.

The same creasing process was performed on flap 120B to produce corresponding creases 132' and 134'. The fold in crease 134' has created a pocket for flange 512B of edging 512. It will be noticed that the side of flap 120B has been trimmed to match to beveling in the end of flange 512B. As shown for flap 120A, the beveling does not extend beyond the edging 412 and the outlying section of the flap has been squared off.

Also, a rectangular region 134 has been left between the edgings 412 and 512, near the corner distinguished by slit 330. Rectangular region 134 has fold lines 134A, 134B, and 134C whose purpose will be described presently.

It will be appreciated that crease 132' was created with edging 512 absent. However, now that edging 512 is in place as shown, crease 132' is ostensibly not far out enough to allow crease 312' to simultaneously reach around the now-present edging 512 and arrive at corner 110E. This means that the installer must apply tension by pulling on flap 120B and edging 512, in order to bring the inside corner of edging 512 up to the substrate corner 110E (It will be understood that the flap opposite to flap 120B is resisting this tension, in a manner that will be described presently.)

Figure 12:
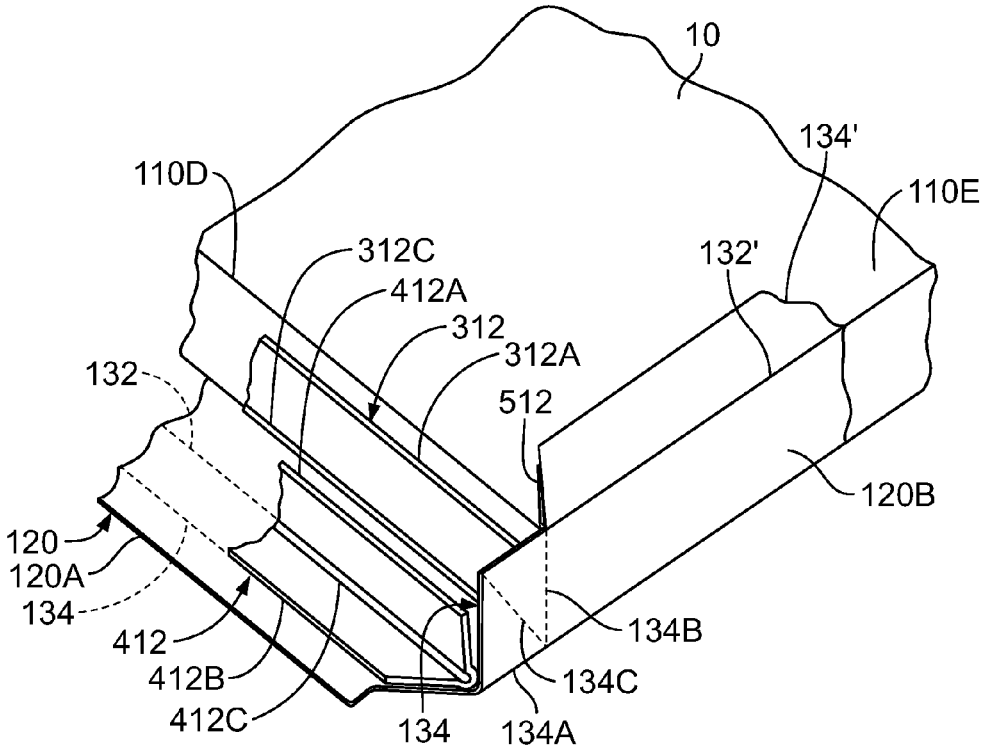
FIG. 12 is a fragmentary, perspective view of a layout that follows the setup of FIG. 11.
Figure 13:
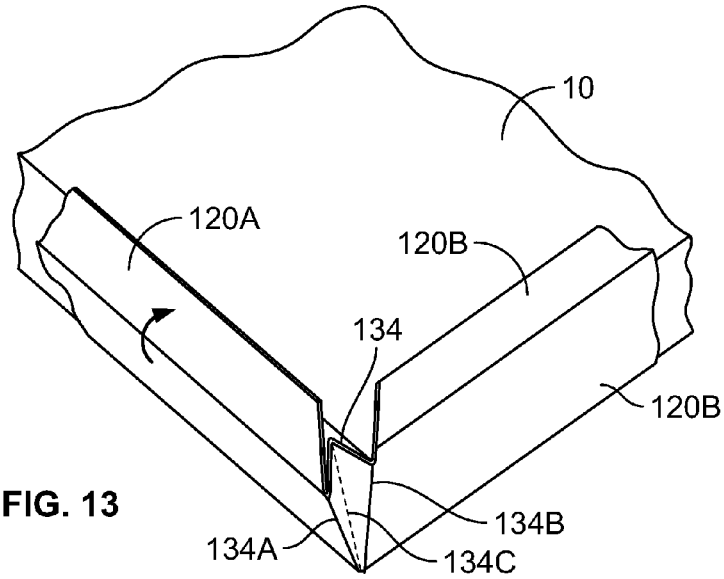
FIG. 13 is a fragmentary, perspective view of a layout that follows the layout of FIG. 12.

Referring to FIGS. 12 and 13, corner edging 512 has been pulled up so that its inside corner embraces corner 110E.

As with flap 120B, flap 120A will be a folded around the distal edge of flange 412B, before applying tension to the flap and edging in order to bring the inside corner of edging 412 onto substrate corner 110D.

As shown in FIG. 13, when pulling flap 120A into position, rectangular region 134 will be tucked inwardly by folding it as shown along fold lines 134A, 134B, and 134C. This will produce a clean seam without any extraneous sheet material visible.

Figure 14:
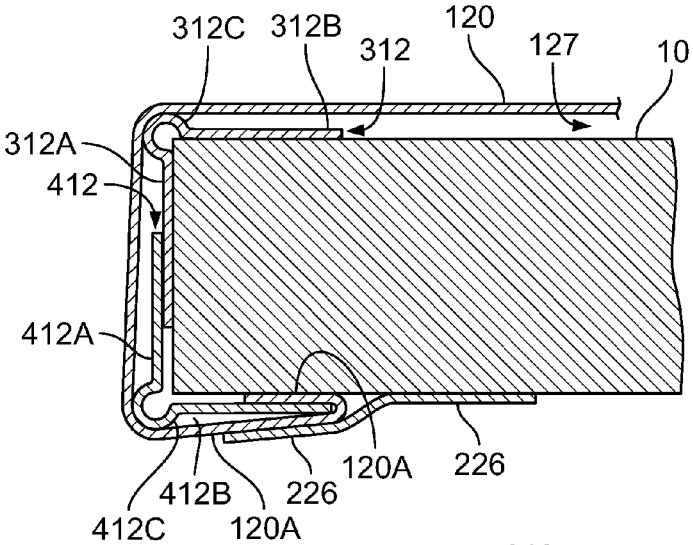
FIG. 14 is a cross-sectional, elevational view through one of the ends of the layout of FIG. 13 after installation is completed.

Referring to FIG. 14, edging 412 is shown in its final position. Flange 412B is shown up against the back of substrate 10 with a section of flap 120A intervening between the flange and the substrate. Flange 412A is shown facing the edge of substrate 10 with flange 312A intervening between the substrate and flange 412A. To keep the assembly in place reliably, adhesive tape 226 has been laid down, reaching from the back of substrate 10 to a portion of flap 120A overlying flange 412B.

As was previously mentioned, tension applied to flap 120A and flap 120B is resisted by tension in flaps (not shown) on the opposite side. This resistance is created by securing that opposite flap using the method just described for flap 120B (although one of the other methods described above can be used instead). The securing of these two opposing flaps can be performed in succession. Alternatively, both flaps can be prepared by creating for both the conditions shown for flap 120B of FIG. 11, and then simultaneously lifting both flaps to achieve the orientation shown in FIG. 12 for flap 120B.

Figure 15:
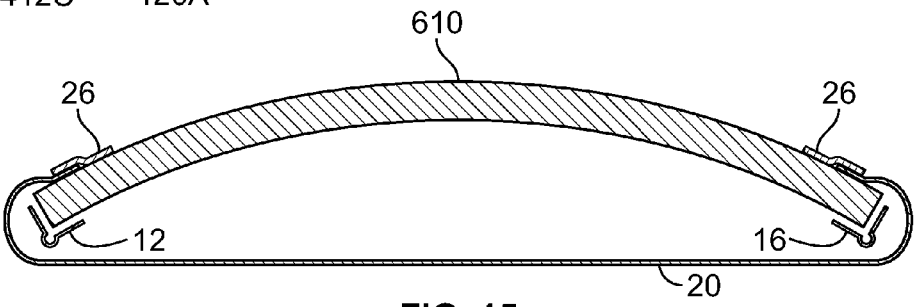
FIG. 15 is a cross-sectional view of an arrangement that is an alternate to those mentioned above, and shown with a substrate bowed before completing the mounting of a sheet.

Referring to FIG. 15, substrate 610 may be a high-density foam, similar to that previously described, although in this embodiment good results are achieved if the substrate is not made from two slabs (e.g., slabs 10A and 10B of FIG. 1). The assembly method proceeds by first taping one end of previously mentioned sheet 20 to the back of substrate 610, near its periphery. Next, substrate 610 is temporarily bowed by hand so its front becomes concave, bringing its two front corners closer together. Thereafter, the opposite edge of sheet 20 is taped to the back of substrate 610 while it is still bowed.

The inside corner of previously mentioned corner edgings 12 and 16 may be placed on the front corners of substrate 610 at this time, although in some cases one may pre-position the edgings and, optionally, hold them in place with adhesive tape, nails, or other fastening means.

Substrate 610 may now be released to end the bowing and allow the substrate to return to its normal flat condition. This release causes the front corners of substrate 610 to spring back and apply tension to sheet 20 to create a condition similar to that shown in FIG. 6.

Figure 16:
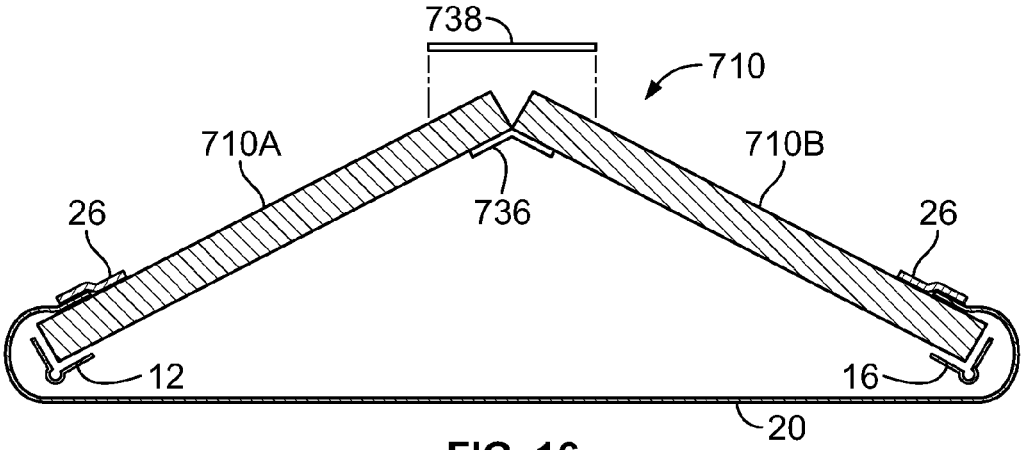
FIG. 16 is a cross-sectional view of an arrangement that is an alternate to that of FIG. 15.

Referring to FIG. 16, substrate 710 is made of two equally-sized solid panels 710A and 710B of high-density foam, or other materials. Panels 710A and 710B are hinged together with a strip of adhesive tape 736. Tape 736 is positioned so that panels 710A and 710B can be swung into an abutting position, although in this Figure they are shown hinged apart leaving an opening in the back. Accordingly, the distal front corners of panels 710A and 710B are closer together than they would be if lying flat.

Next, opposite edges of sheet 20 are taped with adhesive tape 26 to the back of panels 710A and 710B near their distal edges. Corner edgings 12 and 16 may be placed at the front corners of panels 710A and 710B, either before or after the taping of sheet 20.

Substrate 710 is now pressed to bring the joint between panels 710A and 710B close to the central portion of sheet 20. Eventually, the panels 710A and 710B are abutting and coplanar and substrate 710 is flat. Once this condition is achieved, the assembler then applies adhesive tape 738 across the back of the joint between panels 710A and 710B. Since panels 710A and 710B are taped in front and back, they no longer have a free hinge joint and substrate 710 functions as a single entity.

The flattening of substrate 710 causes the front corners of the substrate to move apart and apply tension to sheet 20 to create a condition similar to that shown in FIG. 6.

Figure 17:
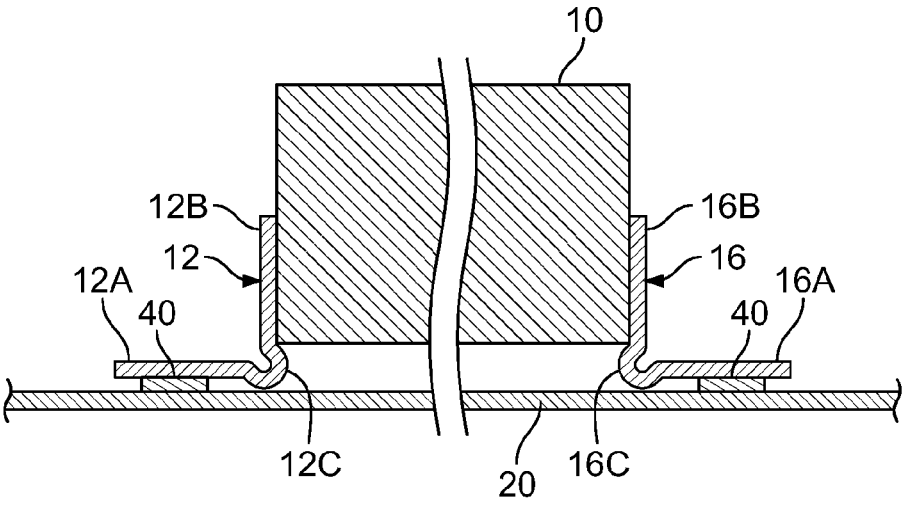
FIG. 17 is an elevational view, with portions broken away for clarity, of a setup that can be used with any of the apparatus of FIGS. 1-6.

Referring to FIG. 17, sheet 20 is laid flat and previously mentioned corner edgings 12 and 16 are secured to the sheet with double-sided adhesive strips 40. Before being secured by adhesive strips 40, the spacing between the opposing pair of separate corner edgings segments 12 and 16 is established by using opposite edges of substrate 10 as a gauge.

Specifically, the unsecured, free flanges 12B and 16B are placed flat against substrate 10, with the substrate elevated above the beads 12C and 16C, and adjacent flanges 12A and 16A oriented to project outwardly along sheet 20. Once in the correct position, adjacent flanges 12A and 16A are then secured onto strips 40. Note that now, if one were to try to push substrate 10 down, the substrate would need to push beads 12C and 16C away, thereby placing sheet 20 under tension.

Figure 18:
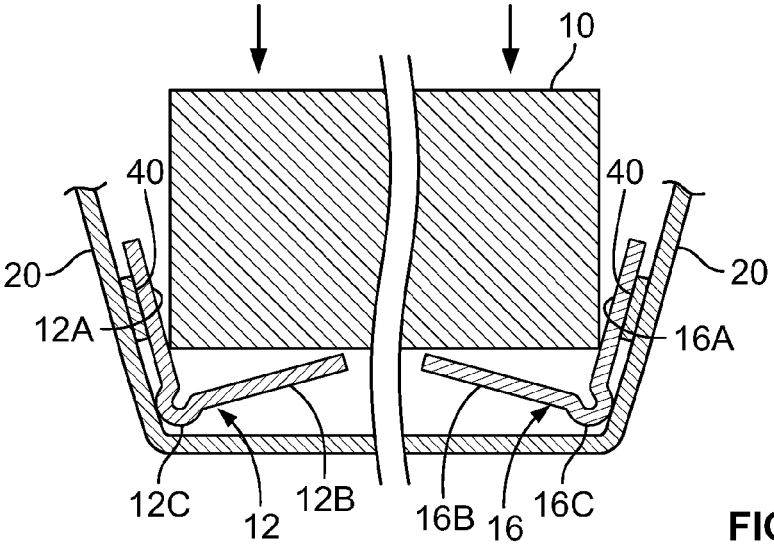
FIG. 18 is an elevational view of a layout that follows the setup of FIG. 17.

Instead, substrate 10 is now removed and the assembler rotates edging segments 12 and 16 as shown in FIG. 18 to bring free flanges 12B and 16B closer to sheet 20. At the same time substrate 10 is pressed downwardly to bring it flat against flanges 12B and 16B. This completes the rotation of edgings 12 and 16, and brings flanges 12A and 16A flat against the edges of the substrate 10.

It will be noticed that during this operation, beads 12C and 16C rolled inwardly across sheet 20, thereby making the clearance for substrate 10 between flanges 12A and 16A even tighter. Accordingly, the foregoing operation produces tension in the central portion of sheet 20, without the need for special manipulation or special tools.

Finally, the distal ends of sheet 20 can be trimmed to be coterminous with flanges 12A and 16A, or can be folded around the back of substrate 10 and taped down as shown in FIG. 6.

Figure 19:
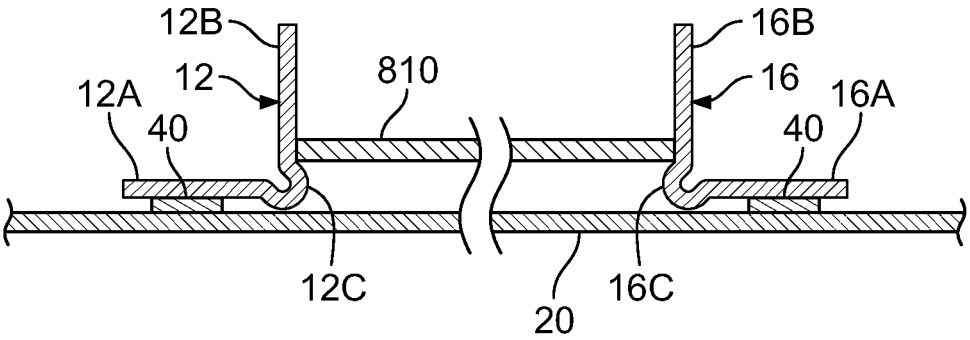
FIG. 19 is an elevational view, with portions broken away for clarity, of a setup that can be used with any of the apparatus of FIGS. 1-6.

Referring to FIG. 19, this setup is the same as was shown for FIG. 17, except that a relatively thin substrate 810 is used in this embodiment. Substrate 810 can be a thin panel of metal, plastic, wood, plywood, etc. As before, substrate 810 is used as a gauge to set the spacing between flanges 12B and 16B before securing flanges 12A and 16A on sheet 20 with double-sided adhesive strip 40.

Figure 20:
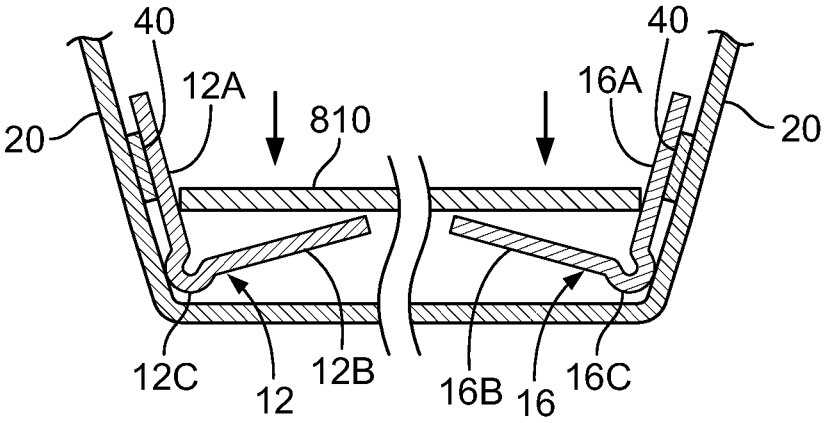
FIG. 20 is an elevational view of a layout that follows the layout of FIG. 19.

Referring to FIG. 20, substrate 810 is shown being pressed downwardly to lie flat against flanges 12B and 16B. Again, the rotation of corner edging segments 12 and 16 applies tension in the central portion of sheet 20. The distal ends of sheet 20 can be trimmed to be coterminous with flanges 12A and 16A, or can be folded around those flanges.

Obviously, many modifications and variations of the present invention are possible in light of the above teachings. It is therefore to be understood that within the scope of the appended claims, the invention may be practiced otherwise than as specifically described.

The invention claimed is:

1. A method for installing a sheet on a substrate having a front and one or more sides, the method using a corner edging with a corner bead, the method comprising the steps, performed in any order, of:

placing the corner edging around the substrate peripherally;

positioning the sheet on the bead of the corner edging;

stretching the sheet over the bead to elevate a central portion of the sheet from the front of the substrate; and after stretching the sheet, peripherally securing the sheet in place, keeping a peripheral portion of the sheet that extends distally beyond the corner bead elevated from the corner edging and from the one or more sides of the substrate.

2. A method according to claim 1 comprising the step of:

manually marking an artistic image on the sheet after the step of peripherally securing the sheet to the substrate.

3. A method according to claim 1 wherein the corner edging has a transverse pair of flanges forming an inside corner and an outside corner, the bead projecting distally away from the outside corner, the step of placing the corner edging being performed by placing the inside corner against the substrate.

4. A method according to claim 3 wherein the substrate has a plurality of substrate edges, the method comprising the step of:

cutting the corner edging into a plurality of separate edging segments, the step of placing the corner edging being performed by placing each of the plurality of separate edging segments on a different corresponding one of the plurality of substrate edges.

5. A method according to claim 1 wherein the substrate has a front and back, the step of peripherally securing the sheet being performed by wrapping the sheet around the substrate and fastening the sheet to the back of the substrate.

6. A method according to claim 1 wherein the step of peripherally securing the sheet is performed by taping the sheet to the substrate.

7. A method according to claim 1 wherein the step of peripherally securing the sheet is performed by gluing the sheet to the substrate.

8. A method according to claim 1 wherein the step of peripherally securing the sheet is performed by stapling the sheet to the substrate.

9. A method according to claim 1 employing a double sided adhesive strip, wherein the step of peripherally securing the sheet includes the steps of:

applying the adhesive strip to the substrate, and peripherally pressing the sheet against the adhesive strip.

10. A method for installing a sheet on a substrate using an adhesive tape, a double sided adhesive strip, and a corner edging with a corner bead, the method comprising the steps, performed in any order, of:

placing the corner edging around the substrate peripherally;

positioning the sheet on the bead of the corner edging;

stretching the sheet over the bead to elevate a central portion of the sheet from the substrate; and peripherally securing the sheet in place by:

applying the adhesive strip to the substrate, and peripherally pressing the sheet against the adhesive strip; and laying the adhesive tape to reach from a peripheral position inwardly over the sheet and the double sided adhesive strip to an interior position on the substrate beyond the sheet.

11. A method for installing a sheet on a substrate using a lower edging, and a corner edging with a corner bead, the method comprising the steps, performed in any order, of:

placing the corner edging around the substrate peripherally;

attaching the lower edging below the corner edging and the around the substrate peripherally;

positioning the sheet on the bead of the corner edging;

stretching the sheet over the bead to elevate a central portion of the sheet from the substrate; and peripherally securing the sheet in place.

12. A method according to claim 1 employing pliers, wherein the step of stretching the sheet is performed by peripherally gripping the sheet and pulling the sheet with the pliers.

13. A method according to claim 12 wherein the step of pulling the sheet is performed by rolling the pliers against the substrate to create leverage for enhancing pulling force produced by the pliers.

14. A method for installing a sheet on a substrate using a corner edging with a corner bead, the method comprising the steps, performed in any order, of:

placing the corner edging around the substrate peripherally;

positioning the sheet on the bead of the corner edging;

stretching the sheet over the bead to elevate a central portion of the sheet from the substrate;

peripherally securing the sheet in place;

temporarily bowing the substrate before peripherally securing the sheet to the substrate; and releasing bowing in the substrate in order to increase tension in the sheet.

15. A method for installing a sheet on a substrate using a corner edging with a corner bead, wherein the substrate is a pair of solid panels each having a front and a back, the method comprising the steps, performed in any order, of:

attaching said pair of solid panels by hinging them together along their fronts;

placing the corner edging around the substrate peripherally;

positioning the sheet on the bead of the corner edging;

stretching the sheet over the bead to elevate a central portion of the sheet from the substrate;

temporarily bowing the substrate by hingedly rotating them before peripherally securing the sheet to the substrate;

peripherally securing the sheet in place;

flattening the substrate in order to increase tension in the sheet; and securing the pair of solid panels along their backs to keep the substrate flat.

16. A method for installing a sheet on a substrate using a corner edging with a corner bead, wherein the corner edging has a plurality of notches, the method comprising the steps, performed in any order, of:

placing the corner edging around the substrate peripherally by using the plurality of notches to bend the corner edging into a curve accommodating curvature of the substrate;

positioning the sheet on the bead of the corner edging;

stretching the sheet over the bead to elevate a central portion of the sheet from the substrate; and peripherally securing the sheet in place.

17. A method according to claim 16 wherein the corner edging comprises a plurality of separate edging segments, the substrate being annular and having an outside edge and an inside opening, the step of placing the corner edging being performed by positioning one of the edging segments on the outside edge, and another one of the edging segments about the inside opening.

18. A method according to claim 1 comprising the step of nailing the corner edging to the substrate.

19. A method for installing a sheet on a substrate using a fastener and a corner edging with a corner bead, wherein the substrate is a solid panel of high density foam, the method comprising the steps, performed in any order, of:

placing the corner edging around the substrate peripherally;

positioning the sheet on the bead of the corner edging;

stretching the sheet over the bead to elevate a central portion of the sheet from the substrate;

peripherally securing the sheet in place;

securing the fastener to a wall projecting proud; and pushing the high density foam against the fastener to impale the foam on the fastener.

20. A method for installing a sheet on a substrate using a corner edging with a corner bead, wherein the substrate is a plurality of solid panels of high density foam, the method comprising the steps, performed in any order, of:

attaching said plurality of solid panels side by side to form a single front surface;

placing the corner edging around the substrate peripherally;

positioning the sheet on the bead of the corner edging;

stretching the sheet over the bead to elevate a central portion of the sheet from the substrate; and peripherally securing the sheet in place.

21. A method for installing a sheet on a substrate using a corner edging with a corner bead, wherein the corner edging has an opposing pair of separate edging segments, each with a free flange and an adjacent flange transverse to the free flange, the method comprising the steps, performed in any order, of:

placing the corner edging around the substrate peripherally;

positioning the sheet on the bead of the corner edging;

stretching the sheet over the bead to elevate a central portion of the sheet from the substrate; and peripherally securing the sheet in place, the step of peripherally securing the sheet comprising the step of:

securing the opposing pair of separate edging segments to the sheet using the substrate as a gauge to establish spacing between the free flanges of said opposing pair, each of the opposing pair having its adjacent flange secured to the sheet and oriented to project outwardly along said sheet, the step of stretching the sheet being performed by:

rotating the pair of separate edging segments to bring their free flanges closer to the sheet while pressing the substrate to bring it flat against the free flanges.

22. A mounting system comprising:

a substrate having a front, a back, and one or more sides;

an edging having a front flange, a side flange, and a prominent bead, said edging being positioned on said substrate peripherally with the front flange on the front of the substrate, and the side flange on the one or more sides of the substrate; and a sheet positioned over said bead and under tension to lift away from the front of said substrate, the side flange, and the one or more sides of the substrate, said sheet being peripherally secured in place.

23. A mounting system according to claim 22 wherein said edging has a transverse pair of flanges forming an inside corner and an outside corner, said bead projecting distally away from said outside corner.

24. A mounting system according to claim 22 wherein said edging is elongated and the bead is rounded.

25. A mounting system according to claim 23 wherein at least one of said pair of flanges has a plurality of nail holes.

26. A mounting system according to claim 22 wherein the substrate has a periphery surrounding an internal region occupied by solid material.

27. A mounting system according to claim 26 wherein said substrate comprises a solid slab of high density foam.

28. A mounting system according to claim 26 wherein said substrate comprises a plurality of solid slabs of high density foam mounted side by side.

29. A mounting system according to claim 22 wherein the sheet is adhesively secured peripherally to said substrate.

30. A mounting system according to claim 22 comprising an adhesive tape, the sheet being secured peripherally to said substrate by said adhesive tape.

31. A mounting system according to claim 22 wherein the sheet is secured to the back of said substrate.

32. A mounting system comprising:

a substrate having a front and a back;

an edging having a prominent bead, said edging being positioned on said substrate peripherally;

a sheet positioned over said bead and under tension to lift away from the front of said substrate, said sheet being peripherally secured in place; and a lower edging mounted on said substrate below the corner edging.

33. A mounting system comprising:

a substrate having a front and a back;

an edging having a prominent bead, said edging being positioned on said substrate peripherally;

a sheet positioned over said bead and under tension to lift away from the front of said substrate, said sheet being peripherally secured in place; and a double sided adhesive strip mounted between said substrate and said sheet at a location of said sheet distal from said edging.

34. A mounting system according to claim 33 comprising:

an adhesive tape, said sheet being secured peripherally to said substrate by said adhesive tape.

35. A mounting system according to claim 22 wherein said sheet comprises canvas.

36. A mounting system according to claim 22 wherein said sheet comprises a split microfiber, non-woven sheet.

37. A mounting system according to claim 22 wherein said edging comprises a plurality of separate edging segments.

38. A mounting system according to claim 37 wherein one or more adjacent pairs of said plurality of edging segments are arranged with a miter joint.

39. A mounting system comprising:

a substrate having a front and a back, wherein said substrate has a periphery with at least portions of said periphery being curved;

an edging having a prominent bead, said edging being positioned on said substrate peripherally, said edging having a spaced plurality of notches to allow curving of said edging in order to accommodate curvature of said substrate; and a sheet positioned over said bead and under tension to lift away from the front of said substrate, said sheet being peripherally secured in place.

40. A mounting system comprising:

a substrate having a front and a back, wherein said substrate is annular and has an outside edge and an inside opening;

an edging having a prominent bead, said edging being positioned on said substrate peripherally, said edging comprising a plurality of separate edging segments, one of said plurality of edging segments being positioned on said outside edge, another one of said plurality of edging segments being positioned about said inside opening; and a sheet positioned over said bead and under tension to lift away from the front of said substrate, said sheet being peripherally secured in place.

41. An edging for accommodating mounting of a sheet onto a substrate, comprising:

a plurality of elongated edging segments surrounding a central region, each having a transverse pair of flanges forming an inside corner and an outside corner, each of said plurality of edging segments having a bead, said bead projecting distally away from said outside corner, the bead having a hollow region that is accessible through the inside corner, a first one of the pair of flanges of each of the plurality of edging segments being disposed on a common plane, for each of the plurality of edging segments the bead projecting outwardly away from the central region further than the transverse flanges.

42. An edging according to claim 41 wherein at least some of the plurality of edging segments have a mitered end.

43. An edging for accommodating mounting of a sheet onto a substrate, comprising:

a plurality of elongated edging segments, each having a transverse pair of flanges forming an inside corner and an outside corner, each of said plurality of edging segments having a bead, said bead projecting distally away from said outside corner, a given one of the plurality of edging segments being curved, at least one of the pair of flanges of the given one having a spaced plurality of notches to accommodate curvature of the given one.

44. A method according to claim 1 wherein the corner edging has an inside corner with two transverse surfaces, the corner bead having a hollow region that is accessible through the inside corner, the step of placing the corner edging around the substrate being performed to allow the substrate to travel inwardly and beyond the two transverse surfaces of the inside corner in order to enter the hollow region.

45. A method according to claim 1 wherein the substrate is a solid slab with a frontal border encompassing the front of the substrate, the step of placing the corner edging being performed to engage the slab along most of the frontal border.

46. A method for installing a sheet on a substrate, the method employing a corner edging with a corner bead, the corner edging having an inside corner formed of two transverse surfaces, the corner bead having a hollow region that is accessible through the inside corner, the method comprising the steps, performed in any order, of:

placing the corner edging around the substrate peripherally and allowing the substrate to travel inwardly and beyond the two transverse surfaces of the inside corner in order to enter the hollow region;

positioning the sheet on the bead of the corner edging;

stretching the sheet over the bead to elevate a central portion of the sheet from the substrate; and peripherally securing the sheet in place.

* * * * *